United States Patent [19]

Novinski

[11] 4,421,799

[45] Dec. 20, 1983

[54] ALUMINUM CLAD REFRACTORY OXIDE FLAME SPRAYING POWDER

[75] Inventor: Edward R. Novinski, Mineola, N.Y.

[73] Assignee: Metco, Inc., Westbury, N.Y.

[21] Appl. No.: 349,290

[22] Filed: Feb. 16, 1982

[51] Int. Cl.[3] ..... B05D 1/08

[52] U.S. Cl. ..... 427/423; 427/217; 428/403; 428/404; 428/471; 428/472

[58] Field of Search ..... 427/423, 217; 428/402, 428/406, 403, 404, 472, 471, 570

[56] References Cited

U.S. PATENT DOCUMENTS 2,972,529 2/1961 Alexander et al. ..... 428/404

3,069,292 12/1962 Alexander et al. ..... 428/404

3,914,507 10/1975 Fustukian ..... 428/404

3,989,872 11/1976 Ball ..... 428/404

*Primary Examiner*—Shrive P. Beck

*Attorney, Agent, or Firm*—F. L. Masselle; E. T. Grimes; J. D. Crane

[57] ABSTRACT

A flame spray powder comprising particles with a central core of a material selected from the group consisting of zirconium oxide, magnesium oxide, hafnium oxide, cerium oxide, yttrium oxide and combinations thereof. The core then has discrete aluminum particles in a binder deposited therein to form the flame spray powder which may be flame sprayed produce an abradable and erosion resistant coating.

9 Claims, No Drawings

ALUMINUM CLAD REFRACTORY OXIDE FLAME SPRAYING POWDER

This invention relates to flame spray powders which will produce refractory oxide coatings characterized by both abradability and erosion resistance and to a process of flame spraying such coatings.

BACKGROUND OF THE INVENTION

Flame spraying involves the heat softening of a heat fusible material, such as a metal or ceramic, and propelling the softened material in particulate form against a surface which is to be coated. The heated particles strike the surface and bond thereto. A conventional flame spray gun is used for the purpose of both heating and propelling the particles. In one type of flame spray gun, the heat fusible material is supplied to the gun in powder form. Such powders are typically comprised of small particles, e.g., below 100 mesh U.S. standard screen size to about 5 microns.

A flame spray gun normally utilizes a combustion or plasma flame to produce the heat for melting of the powder particles. It is recognized by those of skill in the art, however, that other heating means may be used as well, such as electric arcs, resistant heaters or induction heaters, and these may be used alone or in combination with other forms of heaters. In a powder-type combustion flame spray gun, the carrier gas for the powder can be one of the combustion gases, or it can be simply compressed air. In a plasma spray gun, the primary plasma gas is generally nitrogen or argon. Hydrogen or helium is usually added to the primary gas. The carrier gas is generally the same as the primary plasma gas, although other gases, such as hydrocarbons, may be used in certain situations.

The nature of the coating obtained by flame spraying a metal powder can be controlled by proper selection of the composition of the powder, control of the physical nature of the powder and the use of select flame spraying conditions. It is well known and common practice to flame spray a simple mixture of ceramic powder and metal powder. It is also well known to clad ceramic powder with certain metals, particularly nickel and cobalt, for example, as taught in U.S. Pat. No. 3,254,970. Hard coatings that are quite useful may be produced with such mixtures or clad powders. Such coatings usually contain both ceramic and metal of the powder mixture that is flame sprayed.

In the manufacture of gas turbines, abradable metal compositions have been available for flame spraying onto the gas turbine parts for the purpose of reducing the clearance between the fan or compression blades and the housing. The blades seat themselves within the housing by abrading the coating.

Examples of metal-containing compositions for such abradable use are described in U.S. Pat. Nos. 3,084,064, 3,655,425 and 3,723,165. Such metal-containing compositions, however, are limited to the lower temperature portions of turbine engines, i.e., to portions below about 800° C., because of the oxidizing and corrosive conditions in the higher temperature portions.

Flame sprayed oxides, such as zirconia, have been tried as abradable coatings for the higher temperature sections of turbine engines, but this has been done only with limited success. When such refractory oxides are flame sprayed with sufficient heat, such as with a plasma flame spray gun, to provide a suitably bonded and coherent coating, the abradability of the coating is poor. It has also been found that the blade tips of turbines wear excessively. When an oxide is flame sprayed under conditions of lower heat, many of the particles are not sufficiently melted and are trapped in the coating, thereby reducing the deposit efficiency. The resulting coatings have also been found to be friable and not sufficiently resistant to the erosive conditions of the high velocity gases and debris found in turbine engines.

In view of the foregoing, it is a primary object of the present invention to provide a flame spray powder for producing an abradable coating which is also erosion resistant.

It is a further object of this invention to provide a flame sprayed abradable coating suitable for use in the high temperature portions of a gas turbine engine.

BRIEF DESCRIPTION OF THE INVENTION

The foregoing and other objects of the present invention are achieved by a flame spraying powder for producing a coating which is characterized by being both abradable and erosion resistant. The powder is produced, according to the present invention, by cladding aluminum to a core made of a refractory oxide material, specifically zirconium oxide, hafnium oxide, magnesium oxide, cerium oxide, yttrium oxide or combinations thereof.

DETAILED DESCRIPTION OF THE INVENTION

According to the present invention, a powder has been developed for flame spraying onto substrates by conventional powder flame spraying equipment. The coating produced by the flame spraying of the novel powder is both erosion resistant and abradable. The powder itself is made of refractory oxide particles, such as zirconium oxide or hafnium oxide or stabilized forms thereof. The refractory oxide particles are clad with aluminum using conventional cladding techniques such as described in U.S. Pat. No. 3,322,515.

The reason for obtaining both erosion resistance and abradability is not entirely understood. It is theorized, however, that the aluminum coating reacts exothermically with the oxide core particles or possibly may be oxidized during flame spraying, thereby either providing extra heat to the surface of the refractory oxide core or producing aluminum oxide, which melts into the surface of each particle, thereby in some manner aiding in interparticle bonding. A combination of these two effects or others may be operative; however, it is known that coatings produced using the powder according to the present invention are highly desirable in that they are both erosion resistant as well as abradable.

Zirconium oxide and hafnium oxide, as used herein for core materials, may include stabilized or partially stabilized forms according to well known art. For example, such oxide may additionally contain a portion of calcium oxide, yttrium oxide or magnesium oxide, which stabilizes the zirconium or hafnium oxide crystal structures to prevent crystal transformation in cracking at high temperature. Magnesium zirconate is especially desirable as a core oxide material and may comprise approximately equal molecular amounts of zirconium oxide and magnesium oxide. The refractory oxide core powder may also contain minor portions of one or more additional oxides, such as titanium dioxide or silicon dioxide.

The core oxide powder, as previously mentioned, can be clad with aluminum in the manner taught in U.S. Pat. No. 3,322,515. In the technique taught in that patent, aluminum is clad to the core particles using a binder, such as the conventional binders known in the prior art suitable for forming a coating on such a surface. The binder, according to the present invention, is preferably a varnish containing a resin, such as varnish solids, and may contain a resin which does not depend on solvent evaporation in order to form a dried or set film. The varnish may contain, accordingly, a catalyzed resin. Examples of binders which may be used include the conventional phonolic, epoxy or alkyd varnishes, varnishes containing drying oils, such as tung oil and linseed oil, rubber and latex binders and the like. The binder may additionally be of the water soluble type, such as polyvinylpyrrolidone or polyvinylalcohol type.

The finished flame spray powder should have a particle size between about −100 mesh (U.S. standard screen size) and +5 microns and preferably between −200 mesh and +15 microns. The aluminum should be present in an amount between 0.5% and 15%, and preferably between 1 and 10% based on the total of the aluminum and the core.

EXAMPLE

A flame spray powder according to the present invention is made by mixing 0.35 pounds of finely divided aluminum powder having an average size of about 3.5 to 5.5 microns with 950 cc of a solution containing polyvinylpyrrolidone (PVP) binder. The solution consists of 150 cc of 25% PVP solution, 100 cc of acetic acid and 700 cc of water. The aluminum and binder form a mixture having a consistency of syrup. This mixture is then added to 9.65 pounds of magnesium zirconate particles having a size ranging between −270 mesh U.S. standard screen size and +10 microns. After all the ingredients are thoroughly blended together, the blend is warmed to about 90° C. The blending continues until the binder dries, leaving a free-flowing powder in which all of the core particles of magnesium zirconate are clad with a dry film which contains the aluminum particles. The dry powder is then passed through a 200 mesh screen, U.S. standard screen size. The final size distribution of the dried powder is approximately 43% between −200 and less than +325 mesh and 57% less than −325 mesh. The aluminum content is about 3.5% by weight and the binder solid content about 0.75% by weight based on the total of the aluminum, binder and magnesium zirconate.

This powder is then flame sprayed using a standard powder-type combustion flame spray gun, such as Type 6P sold by Metco Inc., Westbury, N.Y. under the trademark "THERMOSPRAY" gun, using a 6P-7AD nozzle. The spraying is at a rate of 3 to 5 pounds per hour using a Metco Type 3MP powder feeder, using nitrogen carrier gas for the powder, acetylene gas as fuel at a pressure of 12 psi, oxygen at 20 psi, a spray distance of 3 to 7 inches, a traverse rate of 20 feet per minute and preheat temperature of about 150° C. Using this method, coatings of 125 microns to 4 mm in thickness have been produced on a mild steel substrate prepared with a bond coat typically of flame sprayed aluminum clad nickel alloy powder as described in U.S. Pat. No. 3,322,515.

Metallographic examination of the coating produced by the abovedescribed method reveals a highly porous structure containing approximately 40% porosity by volume. The free aluminum content is less than 1% by volume; however, after exposure in air at 1100° C. for about 8 hours, essentially no free aluminum remained. X-ray dispersion analysis of the coating with a scanning electron microscope reveals localized areas of aluminum oxide wetted to the magnesium zirconate bulk structure.

To determine the suitability of the coating material for use in, for example, gas turbine engines, an erosion test was developed for testing the coating. A substrate with the coating was mounted on a water cooled sample holder and a propane-oxygen burner ring surrounding an abrasive feed nozzle was located to impinge on the sample. A −270 mesh to +15 micron aluminum oxide abrasive was fed through a nozzle having a diameter of 4.9 mm with a compressed air carrier gas at 3 l/sec flow to produce a steady rate of abrasive delivery. The flame from the burner produced a surface temperature of approximately 980° C. The results of this test expressed as coating volume loss per unit time were $1.4\times10^{-3}$ cc/sec loss compared with $1.3\times10^{-3}$ cc/sec loss for a neat magnesium zirconate coating.

Abradability of the coating was also tested. This was accomplished by using two Rene 80 TM nickel alloy turbine blade segments mounted to an electric motor. The substrate having the test coating was heated by a propane-oxygen burner ring to approximately 1100° C. and was positioned to bear against the rotating blade segments as they were turned by the motor at a rate of approximately 25,000 rpm. The coating performance is measured as a ratio of the depth of cut into the coating and loss of length of the blades. The ratio for the aluminum clad powder coating was 2.5 as compared with 1.0 for a neat magnesium zirconate coating.

The coating also displayed excellent thermal shock resistance. Coatings disclosed herein may be used in any application that could take advantage of a coating resistant to high temperature, erosion, or thermal shock or having the properties of porosity or erosion resistance. Examples are bearing seals, compressor shrouds, furnaces, boilers, exhaust ducts and stacks, engine piston domes and cylinder heads, leading edges for aerospace vehicles, rocket thrust chambers and nozzles and turbine burners.

While the invention has been described above in detail with reference to specific emobidments, various changes and modifications which fall within the spirit of the invention and scope of the appended claims will become apparent to those skilled in this art. The invention is therefore only intended to be limited by the appended claims or their equivalents.

What is claimed is:

1. A flame spray powder having a central core of a material selected from the group consisting of zirconium oxide, magnesium oxide, hafnium oxide, cerium oxide, yttrium oxide and combinations thereof, and aluminum bonded to the surface of said core wherein said aluminum is in the form of discrete particles bonded to the surface of said core with a binder.

2. The flame spray powder according to claim 1 in which said central core comprises a material selected from the group consisting of zirconium oxide, magnesium oxide and combinations thereof.

3. The flame spray powder according to claim 1 in which said particles have a size between about −100 mesh (U.S. standard screen size) and +5 microns, and said aluminum is present in an amount between 0.5% and 15% by weight based on the total of the aluminum and core.

4. The flame spray powder according to claim 3 in which said particles have a size between −200 mesh (U.S. standard screen size) and +15 microns.

5. A flame spray powder according to claim 3 in which aluminum is present in the amount between 1% and 10% by weight based on the total of the aluminum and core.

6. The flame spray powder according to claim 1 in which said binder is an organic binder.

7. A flame spray powder comprising particles having a magnesium zirconate core coated with a binder containing discrete particles of aluminum, said spray powder particles having a size between about −100 mesh (U.S. standard screen size) and +5 microns, and said aluminum is present in an amount between 1% and 10% by weight based on the total of the aluminum and magnesium zirconate core.

8. A process for producing an abradable coating comprising:

flame spraying flame spray powder particles comprising a core comprising a member selected from the group consisting of zirconium oxide, magnesium oxide, hafnium oxide, cerium oxide, yttrium oxide and combinations thereof, wherein a coating of aluminum is bonded to the surface of said core.

9. The process according to claim 8 in which said flame spraying is accomplished with a combustion flame spray gun.

* * * * *